US006313693B1

(12) United States Patent
Kelm

(10) Patent No.: US 6,313,693 B1
(45) Date of Patent: Nov. 6, 2001

(54) VOLTAGE RATIO CONTROL CIRCUIT FOR USE DURING POWER TRANSITIONS

(75) Inventor: Sigurd Arnulf Kelm, Bavaria (DE)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/613,326

(22) Filed: Jul. 10, 2000

(51) Int. Cl.[7] ..... G05F 1/10
(52) U.S. Cl. ..... 327/540; 307/19
(58) Field of Search ..... 307/19, 28, 45, 307/47, 48, 74, 75; 327/540, 530

(56) References Cited

U.S. PATENT DOCUMENTS

| | | | | |
|---|---|---|---|---|
| 4,550,288 | * | 10/1985 | Schweitzer, Jr. | 324/133 |
| 4,626,697 | * | 12/1986 | Nelson | 307/28 |
| 5,126,651 | * | 6/1992 | Gauen | 323/222 |
| 5,412,308 | * | 5/1995 | Brown | 307/75 |
| 6,011,419 | | 1/2000 | Nowak et al. | 327/310 |

OTHER PUBLICATIONS

An article entitled "Advance Information MPC8260 Hardware Specifications" from POWER PC, Jan. 1, 2000.

* cited by examiner

*Primary Examiner*—Jung Ho Kim
(74) *Attorney, Agent, or Firm*—Jeff D. Limon; Kevin D. Wills

(57) ABSTRACT

An electronics module (FIG. 1, 30) requires two distinct voltage inputs ($V_1$, $V_2$) and can be damaged when the difference between the two voltages exceeds a maximum value during power up. Additionally the electronics module (30) can be damaged during a power down transition when the difference between the two voltages exceeds a maximum negative value. A voltage ratio control circuit (FIG. 8) which includes at least one diode (D1), a capacitor (C1) whose value is proportional to the product of the value of the second voltage source (V2) and the value of the sum of any decoupling capacitances (C2) divided by the difference between the two input voltages is used to reduce the difference between the two voltages. This prevents damage to the electronic module (FIG. 1, 30) during power up and power down transitions caused by excessive voltage differences in the two voltage inputs ($V_1$ and $V_2$).

7 Claims, 4 Drawing Sheets

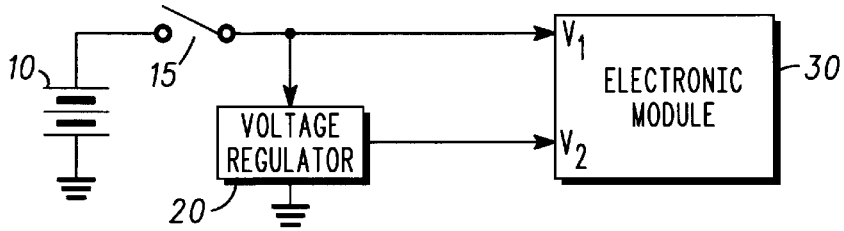
FIG. 1
FIG. 2
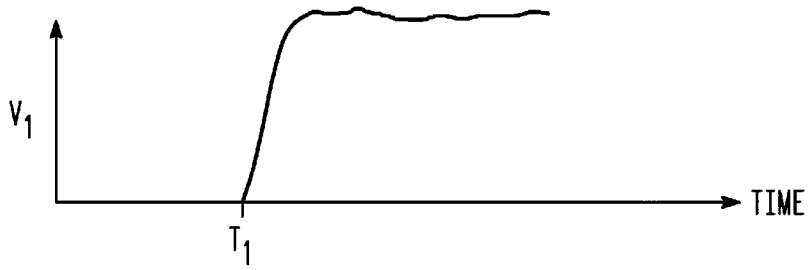
FIG. 3
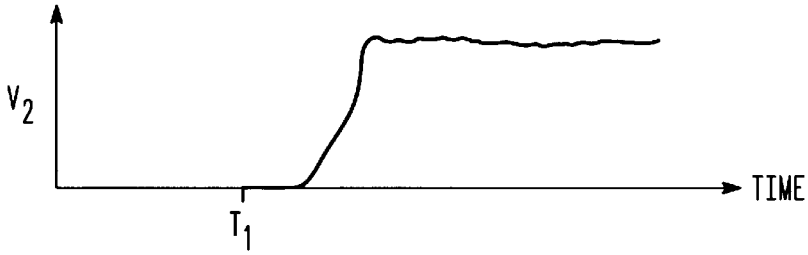
FIG. 4
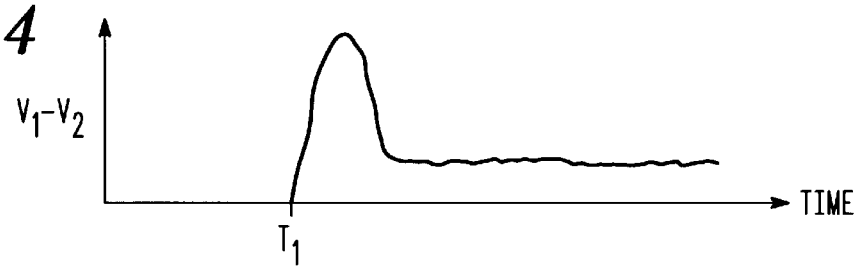
FIG. 5
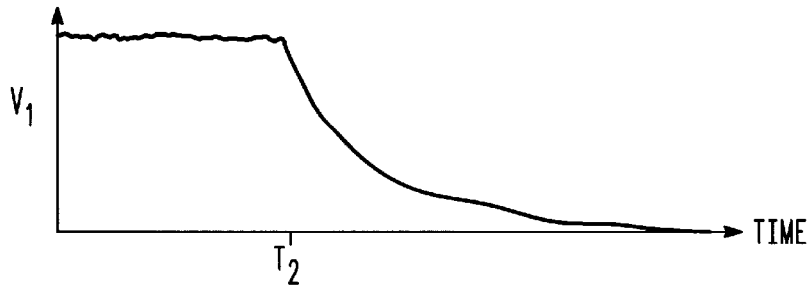

FIG. 6
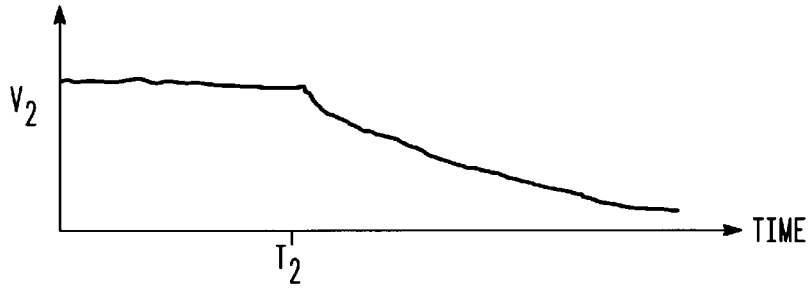
FIG. 7
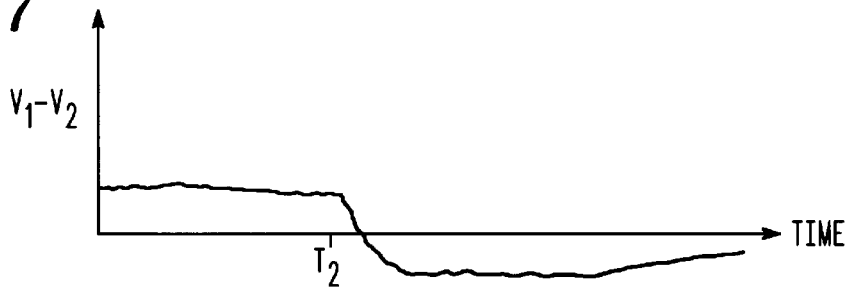
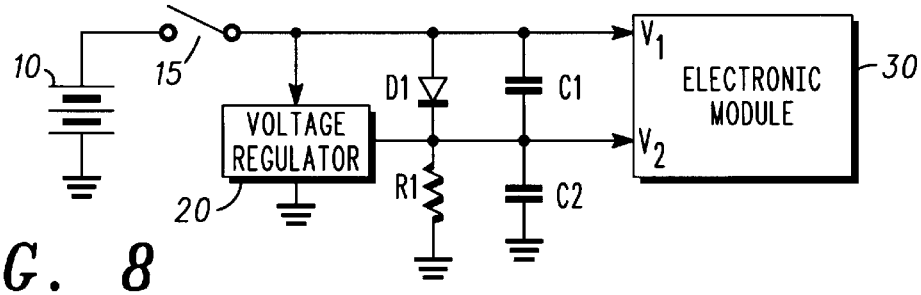
FIG. 8
FIG. 9
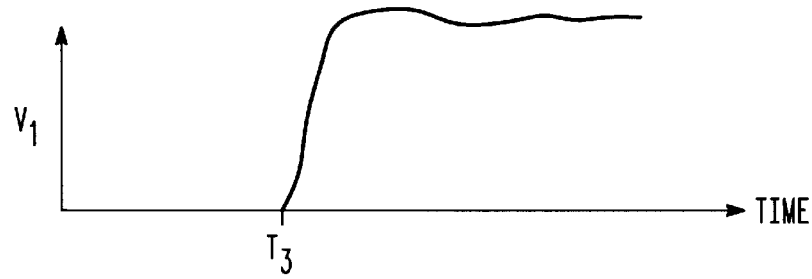
FIG. 10
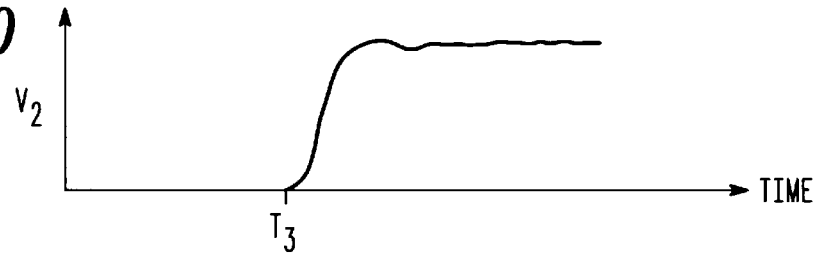

VOLTAGE RATIO CONTROL CIRCUIT FOR USE DURING POWER TRANSITIONS

FIELD OF THE INVENTION

The invention relates to electronic circuits and, more particularly, to techniques for voltage ratio control during power transitions.

BACKGROUND OF THE INVENTION

As electronic systems become more and more highly integrated, components which perform a variety of functions, such as processors and microcontrollers, are becoming integrated onto a single electronic module. Thus, as an example, an electronic module's internal input/output buffers may require 3.3 V, while the module's processor core requires a supply of 2.5 V. This requires that the electronic module be powered by two distinct voltage sources in order to realize the full functionality of the electronic module within the system environment.

In conventional electronic circuits, a single voltage supply is typically used to generate additional voltages which are required at various locations throughout a circuit board or throughout the electronic system. However, modern highly integrated electronic modules may require adherence to strict timing and voltage difference parameters during power transitions. Unfortunately, conventional electronic design techniques are often not sufficient to meet these strict timing and voltage difference parameters, thus allowing the electronic module to be damaged during a power up or power down transition.

Thus, it is highly desirable to employ a voltage ratio control circuit for use during power transitions. This can enable timing and voltage parameters to be observed during these transitions, thus reducing the incidence of damage to the electronic module caused by excessive differences in input voltage.

BRIEF DESCRIPTION OF THE DRAWINGS

The invention is pointed out with particularity in the appended claims. However, a more complete understanding of the present invention may be derived by referring to the detailed description and claims when considered in connection with the figures, wherein like reference numbers refer to similar items throughout the figures, and:

FIG. 1 is an illustration of an electronic circuit which includes an electronics module being supplied by two voltage sources in accordance with conventional design techniques;

FIG. 2 is a graph of a first voltage vs. time during a period which begins immediately before and ends immediately after applying power to the circuit of FIG. 1 in accordance with conventional design techniques;

FIG. 3 is a graph of a second voltage vs. time during a period which begins immediately before and ends immediately after applying power to the circuit of FIG. 1 in accordance with conventional design techniques;

FIG. 4 is a graph of the difference between the first and second voltages of FIGS. 2 and 3 during a period which begins immediately before and ends immediately after applying power to the circuit of FIG. 1 in accordance with conventional design techniques;

FIG. 5 is a graph of a first voltage vs. time during a period which begins immediately before and ends immediately after removing power from the circuit of FIG. 1 in accordance with conventional design techniques;

FIG. 6 is a graph of a second voltage vs. time during a period which begins immediately before and ends immediately after removing power from the circuit of FIG. 1 in accordance with conventional design techniques;

FIG. 7 is a graph of the difference between the first and second voltages of FIGS. 5 and 6 during a period which begins immediately before and ends immediately after removing power from the circuit of FIG. 1 in accordance with conventional design techniques;

FIG. 8 is an illustration of an electronic circuit which incorporates a voltage ratio control circuit in accordance with a preferred embodiment of the invention;

FIG. 9 is a graph of a first voltage vs. time during a period which begins immediately before and ends immediately after applying power to the circuit of FIG. 8 in accordance with a preferred embodiment of the invention;

FIG. 10 is a graph of a second voltage vs. time during a period which begins immediately before and ends immediately after applying power to the circuit of FIG. 8 in accordance with a preferred embodiment of the invention;

DESCRIPTION OF THE PREFERRED EMBODIMENTS

Figure 11:
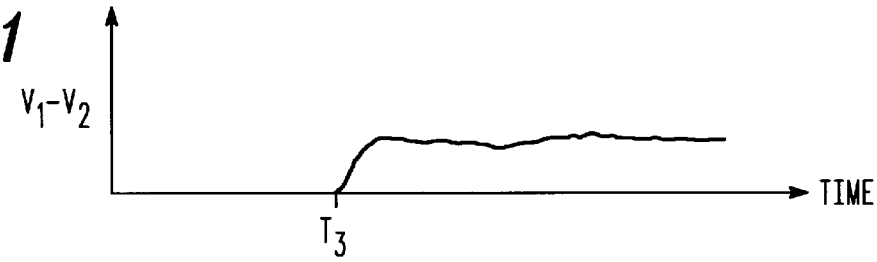
FIG. 11 is a graph of the difference between the first and second voltages of FIGS. 9 and 10 during a period which begins immediately before and ends immediately after applying power to the circuit of FIG. 8 in accordance with a preferred embodiment of the invention.

A voltage ratio control circuit provides a means for stabilizing the relationship between two voltages required to supply power to an electronic module. The circuit, and the method of its operation (disclosed herein), function to reduce the differences between two input voltage sources during power on and power off transitions, as well as during voltage spikes which can occur during steady state operation. According to one aspect of the invention, the voltages supplied to the electronic module can be set to a certain ratio and this ratio can be enforced during any power up and power down transitions. This allows the invention to be used in combination with conventional voltage regulation circuitry which operates under steady state conditions, thus allowing continuous control in the ratio of the two voltages during power transitions as well as steady state operation.

FIG. 1 is an illustration of an electronic circuit which includes an electronics module being supplied by two voltage sources in accordance with conventional design techniques. In FIG. 1, a voltage from voltage source 10 is conveyed to voltage regulator 20 and to a first voltage input of electronic module 30 by way of switch 15. Although illustrated as a battery, voltage source 10 is representative of any suitable direct current voltage source, such as a voltage rail, used in conventional electronic systems. Additionally, switch 15 can be any type of solid-state or mechanical switch which functions to control the power on/off state of electronic module 30 and voltage regulator 20 in accordance with conventional design techniques.

Voltage regulator 20 is supplied with a first voltage which is substantially equal to that of voltage source 10. Using voltage source 10, voltage regulator 20 performs a conversion function which results in a second voltage being present at an output of voltage regulator 20. It is anticipated that voltage regulator 20 is representative of a variety of voltage regulator units available from numerous manufacturers. It is further anticipated that voltage regulator 20 is referenced to ground in order to reduce the effects of variations in the voltage produced by voltage source 10 on the output of voltage regulator 20.

Electronic module 30 requires at least two voltage inputs, which have been identified as $V_1$ and $V_2$ in FIG. 1. As an example, which is not intended to limit the invention in any way, the first input ($V_1$) of electronic module 30 requires a steady-state voltage input of 3.3 V. Continuing with this example, the second input ($V_2$) of electronic module 30 requires a steady-state voltage of 2.5 V. The first input ($V_1$) may be required in order to operate internal input output buffers of electronic module 30, while $V_2$ may be required to supply processor core functions within electronic module 30.

It is anticipated that electronic module 30 requires adherence to strict timing and voltage difference criteria during the power up and power down processes. Therefore, as an example, electronic module 30 may require that the difference between $V_1$ and $V_2$ not be in excess of a maximum value, such as 1.5 V. Additionally, during the power down process of electronic module 30, the module may require that the difference between $V_1$ and $V_2$ not exceed a maximum negative value such as −0.5 V.

FIG. 2 is a graph of a first voltage vs. time during a period which begins immediately before and ends immediately after applying power to the circuit of FIG. 1 in accordance with conventional design techniques. FIG. 2 can thus be representative of the value of $V_1$ as a function of time during the period immediately before and after the closure of switch 15, identified as time $T_1$ in FIG. 2. Upon closure of switch 15 at time $T_1$, $V_1$ can be seen to quickly ramp up to a steady-state value.

FIG. 3 is a graph of a second voltage vs. time during a period which begins immediately before and ends immediately after applying power to the circuit of FIG. 1 in accordance with conventional design techniques. FIG. 3 can thus be representative of the value of $V_2$ from voltage regulator 20 immediately before and after the closure of switch 15, identified as time $T_1$ in FIG. 3. The delay in the ramp up in the value of $V_2$ is representative of the time period required for the components within switching regulator 20 to begin operating prior to a voltage being produced at an output of voltage regulator 20.

FIG. 4 is a graph of the difference between the first and second voltages of FIGS. 2 and 3 during a period which begins immediately before and ends immediately after applying power to the circuit of FIG. 1 in accordance with conventional design techniques. In FIG. 4, it can be seen that the difference between the two voltage inputs to electronic module 30 of FIG. 1 ($V_1$–$V_2$) quickly assumes a substantially large value which approaches the value of $V_1$ of FIG. 1 shortly after the closure of switch 15. It is expected that this disparity between $V_1$ and $V_2$ can cause damage to electronic module 30, or disable the module entirely.

FIG. 5 is a graph of a first voltage vs. time during a period which begins immediately before and ends immediately after removing power from the circuit of FIG. 1 in accordance with conventional design techniques. FIG. 5 can thus be representative of a time shortly before and after opening switch 15 of FIG. 1, which occurs at time $T_2$. As can be seen from FIG. 5, $V_1$ is quickly reduced to a value which approaches 0 Volts.

FIG. 6 is a graph of a second voltage vs. time during a period which begins immediately before and ends immediately after removing power from the circuit of FIG. 1 in accordance with conventional design techniques. FIG. 6 can thus be representative of a time shortly before and after opening switch 15 of FIG. 1, which occurs at time $T_2$. As can be seen from FIG. 6, $V_2$ is quickly reduced to a value which approaches 0 Volts.

FIG. 7 is a graph of the difference between the first and second voltages of FIGS. 5 and 6 during a period which begins immediately before and ends immediately after removing power from the circuit of FIG. 1 in accordance with conventional design techniques. In FIG. 7 it can be seen that the difference between the two voltage inputs ($V_1$–$V_2$) to electronic module 30 of FIG. 1 obtains a significant negative value before returning to a value which approaches 0 Volts. It is anticipated that this disparity between $V_1$ and $V_2$ during the power off transition can degrade or disable electronic module 30.

FIG. 8 is an illustration of an electronic circuit which incorporates a voltage ratio control circuit in accordance with a preferred embodiment of the invention. FIG. 8 includes voltage source 10, switch 15, voltage regulator 20, and electronic module 30, as described in relation to FIG. 1. Additionally, FIG. 8 includes diode D1, capacitor C1, resistor R1, and capacitor C2.

Diodes D1 can be any type of commercially available diode which allows current to flow in one direction while allowing only negligible current to flow in an opposite direction. In alternate embodiments, diode D1 is replaced by any other type of electronic component which includes means for coupling current between the first and second voltage inputs of electronic module 30. For those instances where the difference between the steady-state values of $V_1$ and $V_2$ exceed the forward voltage drop of diode D1, two diodes arranged in a serial fashion can be used in place of diode D1. Additionally, the use of two diodes in place of diode D1 can also be desirable in order to reduce the forward current flow through diode D1 under steady-state voltage conditions which occur between power up and power down transitions.

Capacitor C2 represents the sum of any coupling capacitances which may be present between $V_2$ and ground. It is anticipated that these coupling capacitances are present in order to electrically isolate or decouple the voltage $V_2$ from other parts of the system environment in which the circuit of FIG. 8 unctions.

In a preferred environment of the invention, Cl is calculated by way of the following equation:

$$C1 = \frac{C2 \cdot V_2}{V_1 - V_2}$$

Desirably, both C1 and C2 represent any type of commercially available capacitors.

FIG. 9 is a graph of a first voltage vs. time during a period which begins immediately before and ends immediately after applying power to the circuit of FIG. 8 in accordance with a preferred embodiment of the invention. FIG. 9 is representative of the value of $V_1$ as a function of time during the period immediately before and after the closure of switch 15 at time $T_3$ of FIG. 8. Upon closure of switch 15, act time $T_3$, $V_1$ can be seen to quickly ramp up to a steady-state value.

FIG. 10 is a graph of a second voltage vs. time during a period which begins immediately before and ends immediately after applying power to the circuit of FIG. 8 in accordance with a preferred embodiment of the invention. In FIG. 10, it can be seen that $V_2$ begins to increase immediately after the closure of switch 15 of FIG. 8. This immediate ramping up of $V_2$ is indicative of the application of charge to capacitor $C_2$ caused by the flow of current through $C_1$. This charging boosts the voltage present on $C_2$ during the period between the closure of switch 15, and the generation of voltage $V_2$ from voltage regulator 20.

FIG. 11 is a graph of the difference between the first and second voltages of FIGS. 9 and 10 during a period which begins immediately before and ends immediately after applying power to the circuit of FIG. 8 in accordance with a preferred embodiment of the invention. In FIG. 11, it can be seen that the value of the difference between voltages $V_1$ and $V_2$ remains a small value throughout the power up transition of the circuit of FIG. 8. This ensures that electronic module 30 will not be damaged due to an excessive difference in the value of $V_1$–$V_2$ during a power up transition.

Figure 12:
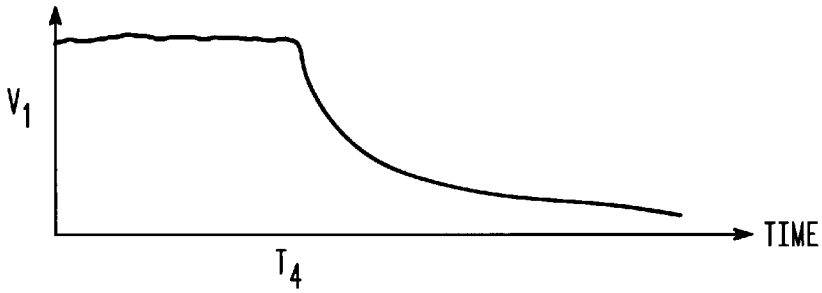
FIG. 12 is a graph of a first voltage vs. time during a period which begins immediately before and ends immediately after removing power from the circuit of FIG. 8 in accordance with a preferred embodiment of the invention.

FIG. 12 is a graph of a first voltage vs. time during a period which begins immediately before and ends immediately after removing power from the circuit of FIG. 8 in accordance with a preferred embodiment of the invention. In FIG. 12, it can be seen that $V_1$ from voltage source 10 quickly drops to a near zero value shortly after the opening of switch 15 of FIG. 8.

Figure 13:
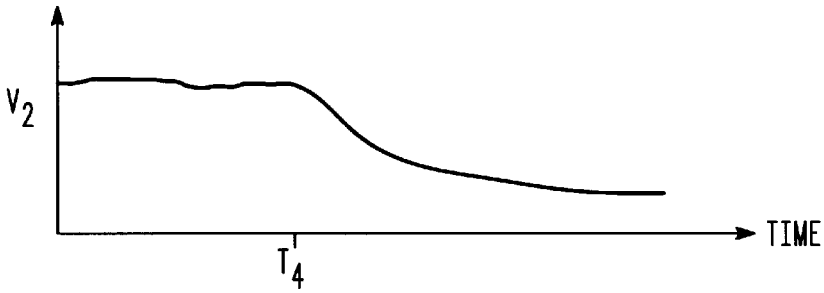
FIG. 13 is a graph of a second voltage vs. time during a period which begins immediately before and ends immediately after removing power from the circuit of FIG. 8 in accordance with a preferred embodiment of the invention.

FIG. 13 is a graph of a second voltage vs. time during a period which begins immediately before and ends immediately after removing power from the circuit of FIG. 8 in accordance with a preferred embodiment of the invention. In FIG. 13, it can be seen that the voltage from voltage regulator 20 quickly drops to nearly 0 Volts shortly after the opening of switch 15 of FIG. 8.

Figure 14:
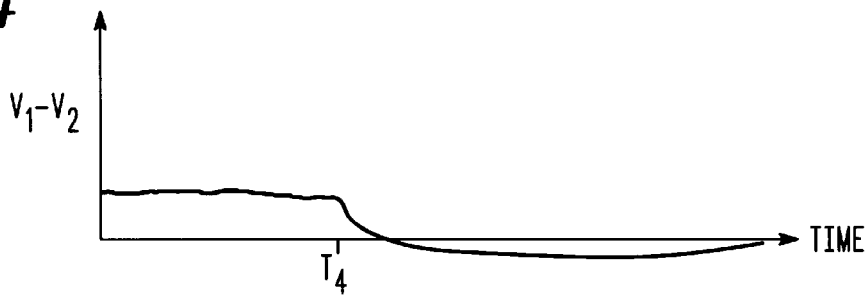
FIG. 14 is a graph of the difference between the first and second voltages of FIGS. 12 and 13 during a period which begins immediately before and ends immediately after removing power from the circuit of FIG. 8 in accordance with a preferred embodiment of the invention.

FIG. 14 is a graph of the difference between the first and second voltages of FIGS. 12 and 13 during a period which begins immediately before and ends immediately after removing power from the circuit of FIG. 8 in accordance with a preferred embodiment of the invention. From FIG. 14, it can be seen that the difference between $V_1$ and $V_2$ obtains a maximum value of only a small negative number before approaching 0 Volts. Thus, any damage to electronic module 30 caused by a significant difference in the value of the two input voltages can be avoided.

Figure 15:
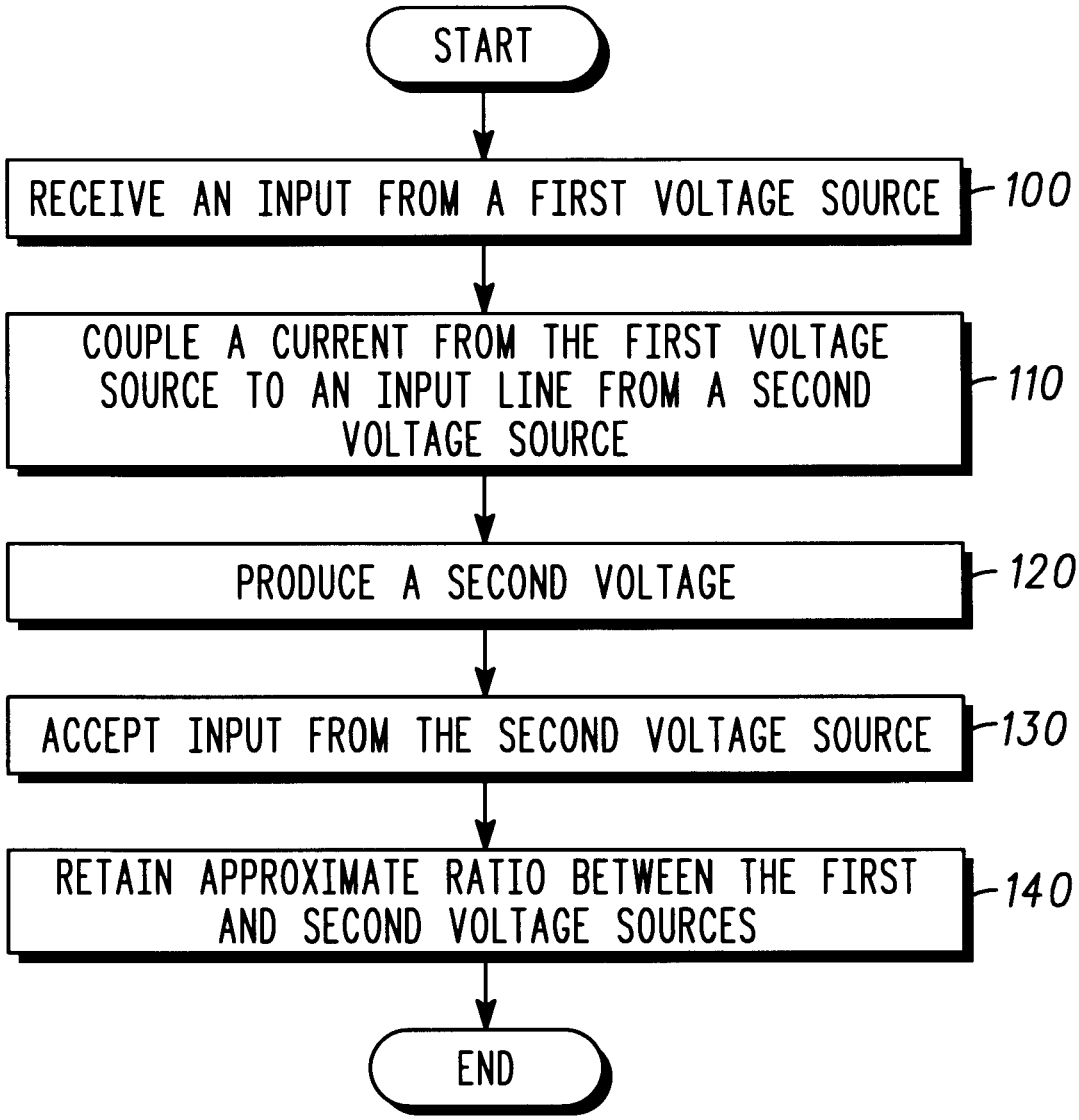
FIG. 15 is a flowchart of a method for reducing a difference between two voltages during a power state transition in accordance with a preferred embodiment of the invention.

FIG. 15 is a flowchart of a method for reducing a difference between two voltages during a power state transition in accordance with a preferred embodiment of the invention. Although the circuit of FIG. 8 is suitable for carrying out the method of FIG. 15, nothing prevents the execution of the method of FIG. 15 using equipment other than that used in the example of FIG. 8.

The method begins at step 100, where an input from a first voltage source is received. The method continues at step 110, which includes coupling a current from the first voltage source to an input line from a second voltage source. The method continues at step 120 where a second voltage is produced or derived using the first voltage source. The method continues at step 130 where an input from the second voltage source is accepted by an electronic module. The method continues at step 140 where the approximate ratio between the first and second voltage source is retained during a power up or power down transitions.

A voltage ratio control circuit provides a means for stabilizing the relationship between two voltages required to supply power to an electronic module. The circuits, and an associated method of operation, function to reduce the differences between two input voltage sources during power on and power off transitions, as well as during voltage spikes which occur during steady state operation. This allows a degree of control over the stability of input voltage sources which is not possible using conventional design techniques. The circuit provides maximum benefit at the moment of transition, thereby allowing enforcement of a certain voltage ratio at all times when operated in conjunction with conventional voltage regulation circuitry.

Accordingly, it is intended by the appended claims to cover all modifications of the invention that fall within the true scope and spirit of the invention.

What is claimed is:

1. An electronic circuit for controlling a ratio between two voltages during a power up condition, comprising:

a first input which accepts a first of said two voltages;

a second input which accepts a second of said two voltages;

at least one diode coupled between said first and second inputs for influencing said second input using said first input;

a first capacitor coupled between said first and second inputs for controlling a voltage ratio between said first and second inputs during said power up condition; and a second capacitor coupled between said second input and a ground, said second capacitor receiving a charge from said at least one diode.

2. The electronic circuit of claim 1, wherein the value of said first capacitor is proportional to the value of said second capacitor.

3. The electronic circuit of claim 2, wherein the value of said first capacitor is also proportional to the value of said second of said two voltages divided by the difference between said first and second of said two voltages.

4. The electronic circuit of claim 1, additionally comprising a resistor coupled between said second input and a ground, said resistor conveying a charge from said second capacitor to said ground.

5. A circuit for controlling a ratio between at least two voltages during a power state transition, comprising:

a first input which accepts a first of said at least two voltages;

a second input which accepts a second of said at least two voltages;

means for coupling current between said first and second inputs, wherein said means comprises at least one diode;

a first capacitor coupled between said first and second inputs for controlling a voltage ratio between said first and second inputs during said power state transition; and a second capacitor coupled between said second input and a ground, said second capacitor receiving a charge from said at least one diode.

6. The circuit of claim 5 wherein the value of said first capacitor is proportional to the value of said second capacitor multiplied by the value of said second of said at least two voltages and divided by the difference of said second of said at least two voltages subtracted from said first of said at least two voltages.

7. The electronic circuit of claim 5, additionally comprising a resistor coupled between said second input and a ground, said resistor conveying a charge from said second capacitor to said ground.

* * * * *